United States Patent [19]

Breidenbach

[11] 4,163,867

[45] Aug. 7, 1979

[54] WIRING ACCESS SYSTEM FOR DESKS AND THE LIKE

[75] Inventor: James H. Breidenbach, Sturgis, Mich.

[73] Assignee: Steelcase Inc., Grand Rapids, Mich.

[21] Appl. No.: 807,901

[22] Filed: Jun. 20, 1977

[51] Int. Cl.[2] ..... A47B 13/00

[52] U.S. Cl. ..... 174/48; 312/223

[58] Field of Search ..... 174/48, 65 R; 312/223; 108/23, 50

[56] References Cited

U.S. PATENT DOCUMENTS

| | | | |
|---|---|---|---|
| 1,905,402 | 4/1933 | Sink | 174/48 X |
| 3,043,643 | 7/1962 | Wilmer | 312/223 X |
| 3,635,174 | 1/1972 | Ball et al. | 312/223 X |
| 3,783,175 | 1/1974 | Timmons | 174/48 |
| 3,787,605 | 1/1974 | Van Gessel et al. | 174/48 |
| 4,053,701 | 10/1977 | Ogilvie et al. | 174/48 |

*Primary Examiner*—E. A. Goldberg
*Assistant Examiner*—D. A. Tone

[57] ABSTRACT

The specification discloses a wiring system for desks, tables and the like in which an end edge trim piece located at the juncture between the top and side of the desk is releasably fastened thereto and can be removed to expose a relatively large aperture extending from the interior to the exterior of the desk to allow one to readily feed wiring therethrough. The edge trim piece itself includes a relatively smaller opening which can then be positioned over the wiring when the end edge trim piece is resecured to the desk, the smaller opening being less noticeable than the larger opening would be. The smaller opening in the trim piece includes a removable insert which can be oriented in different positions to provide yet further adjustment for the size of the opening through which wiring passes as it extends through the end trim piece.

13 Claims, 4 Drawing Figures

WIRING ACCESS SYSTEM FOR DESKS AND THE LIKE

BACKGROUND OF THE INVENTION

The present invention relates to wiring systems for desks or the like. Wiring is often brought into a desk from beneath, is run through some sort of raceway underneath the desk or within the desk, and is then fed out through an access opening generally at the top of the side of the desk and from thence out onto the desk top. In this way, wiring for telephones, dictating machines and other office equipment does not have to hang exposed down the sides of the desk.

The problem of the access openings at the top of the sides of the desk being unsightly and sloppy was solved at least in many applications by a wiring access means disclosed in U.S. Pat. No. 3,787,605 to Robert C. VanGessel and Dirk J. VanKuik, issued on Jan. 22, 1974 and assigned to Steelcase Inc. In that invention, an insert having a plurality of sides with different sized openings on each side could be reoriented within an opening at the top edge of the desk side panel so as to provide a different sized opening for different sized wires coming through the access opening. The system was particularly useful on wood desks where the old sliding door systems of metal desk is not useable.

One problem still remaining with that system is that the access opening into which the wiring insert is fitted is still quite small when it comes to feeding bulky wires through, particularly if they have large connectors on the end thereof as telephone and dictating machine wiring often do. This problem could obviously be corrected by making the wiring insert larger. Unfortunately, the insert itself begins to get unsightly in appearance when one pursues this solution. Yet another obvious solution is to structure the desk end panel so that it is removable. In this way, the wiring can first be located within the desk and set so that it will pass out onto the top of the desk, and then the end panel can be laid over the wiring with the access opening located to receive the wiring. The wiring insert is then placed in the access opening to further tighten the aperture through which the wiring passes.

While these solutions are helpful, they leave the problem unsolved when the desk has an end panel which can not be removed. Further, these solutions create another problem for the user in the field who wants to move his wiring from the left side of the desk to the right side of the desk or vice versa. He would have to change both end panels around in order to accomplish this goal. For most users, such a reconstruction of the desk constitutes major surgery.

SUMMARY OF THE INVENTION

In the present invention, these problems are solved by providing a desk, table or the like with an edge trim piece releasably secured generally at the juncture of the top and side panels of the desk and having a relatively small aperture therethrough. When the edge trim piece is removed, a significantly larger opening is exposed which extends through either the top or side panel or both and which is sufficiently large than even bulky wiring can readily be threaded therethrough. Once the wiring has been so threaded, the edge trim piece is resecured to the desk with the wiring passing through the relatively smaller access opening in the edge trim piece.

Preferably, the attractiveness of the system is further enhanced by providing a removable insert within the access opening in the edge trim piece. This insert has multiple sides with different sized apertures therein and can be reoriented within the access opening to further tailor the size of the wiring aperture to the diameter of the wire or wires passing through the aperture.

These and other objects, advantages and features of the invention will be more fully understood and appreciated by reference to the written specification and appended drawings.

DESCRIPTION OF THE PREFERRED EMBODIMENT

Figure 1:
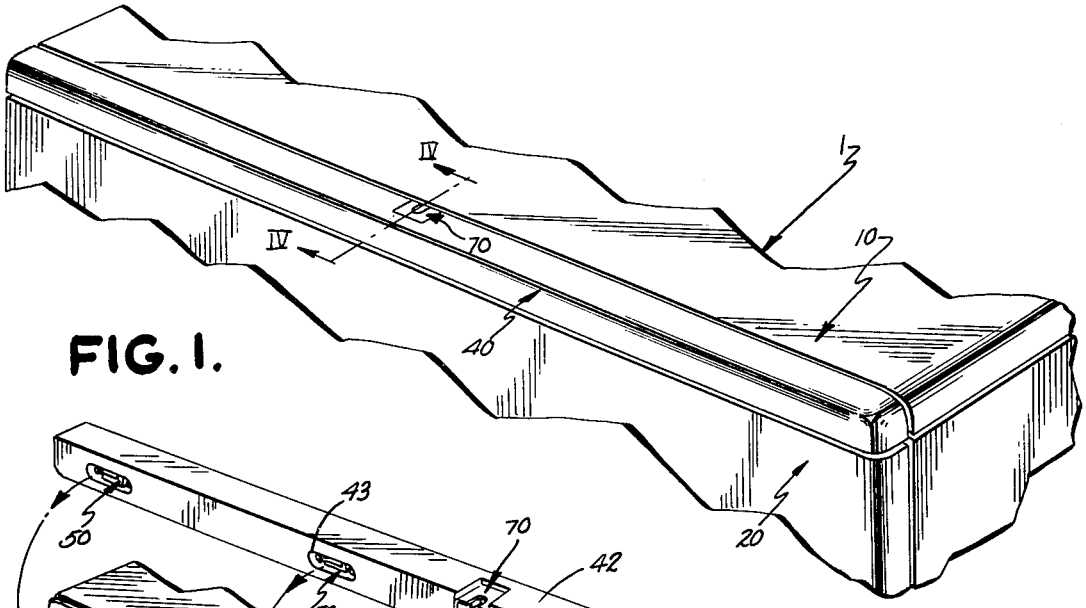
FIG. 1 disclosed a fragmentary perspective view of the upper end edge of a desk in accordance with the present invention.
Figure 4:
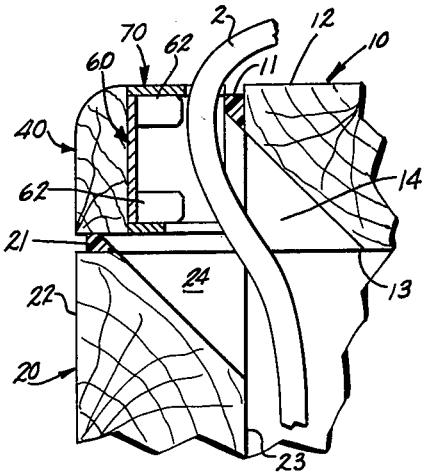
FIG. 4 is a cross-sectional view taken along plane IV—IV of FIG. 1.
Figure 5:
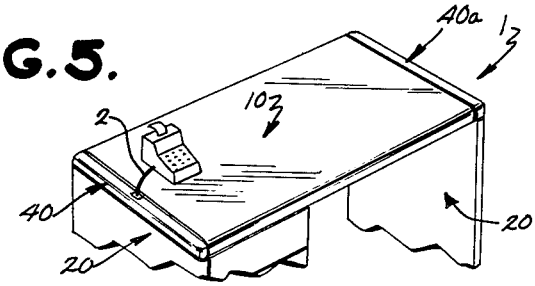
FIG. 5 is a perspective view of the overall desk showing one edge trim piece with an access opening therethrough and the edge trim piece without such an access opening.

In the preferred embodiment, the desk 1 (FIGS. 1 and 5) includes an edge trim piece 40 releasably joined thereto along the adjacent edges of the desk top 10 and the desk side panel 20. As shown, side panel 20 is located at one end of desk 1 and hence might be referred to as an end panel even though the end constitutes a side. Trim piece 40 can be removed exposing a large access opening 14 and 24 extending through end panel 20 and top 10 (FIGS. 2 and 4) through which wiring, especially with bulky connectors, can readily be threaded. A wiring insert 70 can then be oriented and secured within a small access opening 44, held in place by an insert retainer 60, with an appropriate wire receiving aperture oriented upwardly. Then, trim piece 40 is resecured in place by means of the mating recessed clips 50 and studs 30, such that once secured, wiring 2 passes from the interior of the desk, up through large access opening 14 and 24 and through a smaller aperture within the insert 70 located in smaller access opening 44 in edge trim piece 40. (FIGS. 4 and 5).

Figure 2:
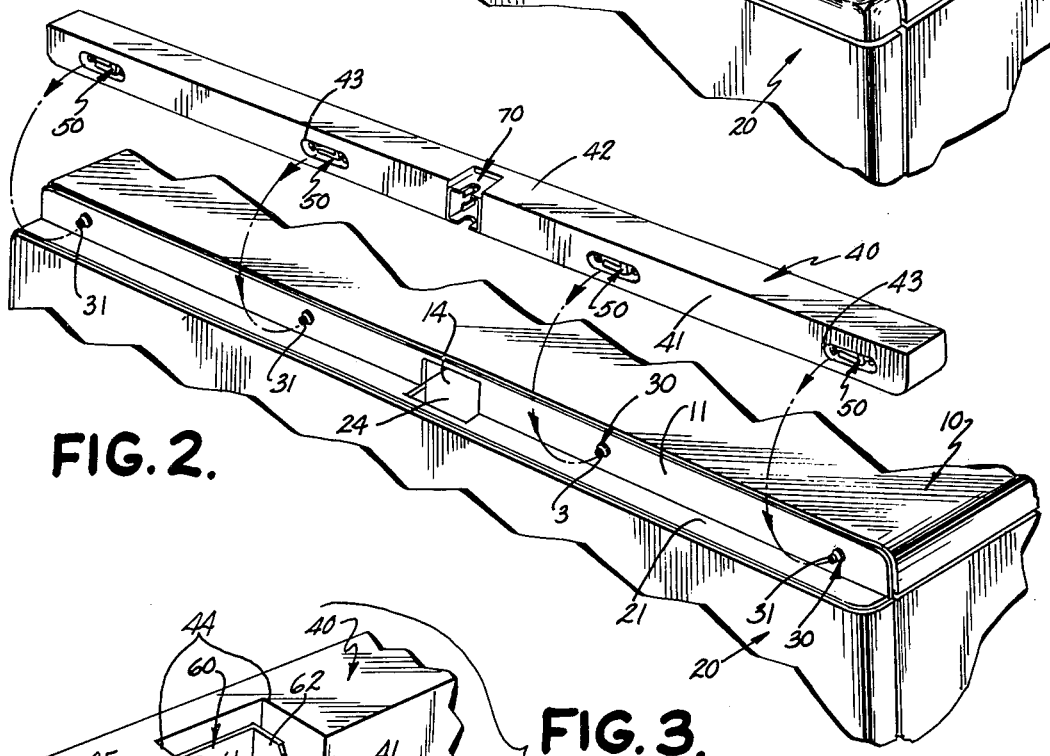
FIG. 2 is a perspective view like FIG. 1 but with the edge trim piece having been removed and flipped over as indicated by the arrows.

When installed, trim piece 40 is located with one of its side surfaces abutting the end edge 11 of desk top 10 and with an adjacent side abutting the top edge 21 of desk end panel 20 (see FIG. 2). For aesthetic purposes, the end edge 11 of desk top 10 is defined by a thin trim strip and similarly, the top edge 21 of desk end panel 20 is defined by a thin trim strip (FIG. 4). However, these could just as well be the raw exposed edges of the desk top 10 and desk end panel 20 respectively.

The desk top 10 and end panel 20 can be made of any conventional desk construction material. The invention is particularly useful in wood desks, however, and accordingly in the preferred embodiment, top 10 and end panel 20 are made of wood.

Top 10 includes an enlarged access opening 14 extending from end edge 11 through to the interior surface 13 (FIG. 4) of top 10. It will be noted that access opening does not extend through the exterior surface of top 10, thus insuring no portion of the opening is visible when trim 40 is in place.

Desk end panel 21 includes an enlarged aperture 24 extending from the upper edge 21 thereof through the inside surface 23 thereof (FIG. 4). It will be noted that aperture 24 does not extend through the exterior surface 22 of end panel 20. This insures that no portion of access aperture 24 will be visible when trim strip 40 is in place.

It is important that the combined access opening 24 and 14 be sufficiently large that large bundles of wiring can be fed therethrough easily. The entire access opening could be located completely in top 10 or in the broadest aspects of the invention, completely in end panel 20. However in the preferred embodiment, at least a portion of the access opening as a whole must be located in top 10 in order to be able to pass wiring through an open end of insert 70, as described below.

Threaded, swaged or otherwise inserted into the end edge 11 of desk top 10 are a plurality of studs 30 (FIG. 2). Each stud 30 has an enlarged head 31. Studs 30 form one half of a releasable securing system which facilitates securing trim piece 40 in place.

The other half of the releasable securing system comprises slotted clips 50 located within recesses 43 along the inside face 41 of trim piece 40 (FIG. 2). The slot within each of the clips 50 is open at one end so that the clips 50 can be slid over the heads 31 of studs 30 to thereby secure end trim piece 40 in place. Such a clip and stud arrangement is known and one example of such a system is disclosed in U.S. Pat. No. 3,491,820 to E. J. Ostling, issued Jan. 27, 1970 and entitled FLEXIBLE JOINT STRUCTURE AND CLIPS THEREFOR. Alternative releasable securing means can be utilized to secure trim piece 40 in place, but it is preferable that some type of snap or sliding fit be employed so that the releasably securing fasteners can be completely hidden from view when edge trim piece 40 is in position.

Edge trim piece 40 itself is made of a material which is decoratively compatible with top 10 and end panel 20. In the preferred embodiment, this material is wood. A relatively small access opening 44 extends from the top surface 45 of edge trim piece 40 through to the bottom surface 42 thereof (See FIGS. 2 and 3). Also, access opening 44 opens outwardly through the inside face 41 of edge trim piece 40. The small access opening 44 is just sufficiently large to accommodate insert 70, and insert 70 has at least one aperture which is just sufficiently large to accommodate the largest anticipated bundle of wiring which might be passed through from the interior of the desk up to the desk top 10.

Figure 3:
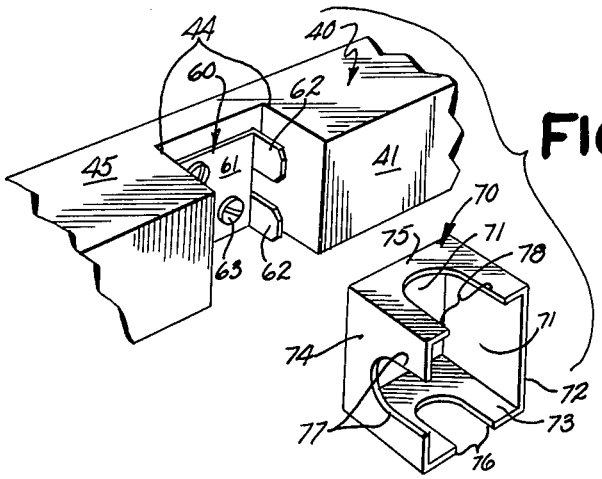
FIG. 3 is an exploded, fragmentary view of the access opening in the edge trim piece and of the insert which fits into the access opening.

Insert 70 has completely open spaced ends 71 (FIG. 3). These ends are framed by one completely closed side 72 which is joined to a second side 73 having a small generally U-shaped aperture 76 therein. Side 73 is joined to side 74 which has a somewhat larger but still medium sized opening 77 therethrough. Side 74 is in turn joined to side 75 which further joins to completely close wall 72 and which itself includes the largest aperture 78. These four sides have equal dimensions so that any one of them may be turned up in small access opening 44. Preferably, insert 70 is made of metal and is chrome plated or otherwise polished so that it is attractive to view.

Insert 70 is secured in place within small access opening 44 by means of an insert retainer 60. Insert retainer 60 includes a back wall 61 having a pair of tabs 62 projecting forwardly from each side edge thereof. Tabs 62 are spaced slightly from the side walls of access opening 44 so that any of the two opposing walls of insert 70 fit snugly between the outside surfaces of tabs 62 and the inside surface of the sidewalls of access opening 44. Thus, tabs 62 are slidable in cross section FIG. 4. Insert 60 is preferably formed of metal and screws 62 are used to fasten the back wall 61 against the back wall of access opening 44.

In use, edge trim piece 40 is removed from the desk and wiring is fed through large access opening 14 and 24. Once the feeding operation has been completed, insert 70 is oriented within access opening 44 with one of its openings 76, 77 or 78 oriented upwardly. The particular opening selected would depend on the size of the bundle of wires extending through access opening 24. Obviously, the larger bundles would be accommodated by aperture 78, the smallest bundles by aperture 76 and the medium sized bundles by aperture 77. In this regard, all of the walls 72, 73, 74 and 75 of insert 70 are the same size so that insert 70 can be oriented with any of them facing upwardly. If no wiring were passing through large access opening 14 and 24, then the completely closed wall 72 of insert 70 would be oriented upwardly.

Once insert 70 is properly oriented within small access opening 44, the entire edge trim piece 40 is positioned along the upper, end edge of the desk with its inside face 41 facing the end edge 11 of top 10 and with its bottom face 42 facing downwardly against the top edge 21 of desk end panel 20. Studs 31 extend into recesses 43 in position at the open end of the slot within clips 50. Edge trim piece 40 is then slid sidewardly so that clips 50 lock over the heads 31 of studs 30. The wiring 2 now extends from the interior of desk 1 through large access opening 14 and 24, through the open end 71 of insert 70, and through an appropriate aperture within insert 70.

It will be noted that it is necessary that, after trim 40 and insert 70 are in place, there be at least some opening, such as 14, through top 10. This allows wiring to feed through the open end 71 of insert 70. Otherwise, the passage of wiring might be blocked by closed wall 72; or passage of a large wire through aperture 78 of wall 75 might be blocked by the too narrow aperture 76 in wall 73.

Preferably, each desk is provided with one edge trim piece 40 as described above and with another edge trim piece 40A which is identical except that it does not include any access opening 44 and does not include any provision for an insert 70. Thus, one end of the desk has no provision for passing wiring. However, either end can readily be changed by simply exchanging edge trim piece 40 with edge trim piece 40A.

Of course, it is understood that the above is merely a preferred embodiment and that various changes and alterations can be made without departing from the spirit and broader aspects of the invention.

The embodiments of the invention in which an exclusive property or privilege is claimed are defined as follows.

1. In a desk, table or the like with a top and side panel, an improved wiring access system comprising: an edge trim piece for locating generally at the juncture of said top and side panel; releasable securing means on said trim piece and on at least one of said top and side panel releasably securing said edge trim piece thereto; a large access opening through at least one of said top and side, said large access opening being normally covered by said trim piece and being large enough to allow a user to readily feed wiring with large connectors therethrough; said edge trim piece including a relatively smaller access opening for allowing wiring to pass therethrough, but being much less noticeable than said large access opening would be; an insert member having at least two apertures therethrough of differing sizes, and insert receiving means located within said small access opening in said trim piece; said insert receiving means and said insert being matingly engageable in at least two different positions with one or the other of said apertures opening to the exterior of said desk whereby the larger of said openings can be oriented to the exterior of said desk when larger diameter wiring has to pass from the interior to the exterior of said desk and the smaller of said openings can be oriented outwardly when smaller diameter wiring has to pass from the interior to the exterior of said desk; said insert including at least one open end which always aligns with at least a portion of said large access opening when said trim piece and said insert are in position on said desk and said insert apertures open into said open end whereby wiring can pass through said open end and out through only one of said apertures if necessary; said insert having at least three sides terminating at said open end each including an aperture which opens into said open end, said apertures being of three different sizes, whereby wiring will pass through said open end and out through one of said insert apertures; said trim piece including a plurality of recesses within at least one inwardly facing face thereof; there being at least one clip located within each said recess; and there being a stud for each said clip located on one of the end edges of said desk top and the upper edge of said desk side; said studs facing said clips once said trim piece is installed whereby said clips can be fitted over said studs to secure said trim piece in place.

2. The desk of claim 1 in which said edge trim piece is located at one end of said desk top; there being another edge trim piece at the opposite end of said top which is identical to said first edge trim piece except that it includes no access opening therethrough; said trim pieces at said opposite ends of said desk being interchangeable whereby wiring can be passed through which ever end of the desk is desired.

3. The desk of claim 1 in which said trim piece includes a plurality of recesses within at least one inwardly facing face thereof; there being at least one clip located within each said recess; and there being a stud for each said clip located on one of the end edges of said desk top and the upper edge of said desk side; said studs facing said clips once said trim piece is installed whereby said clips can be fitted over said studs to secure said trim piece in place.

4. The desk of claim 3 in which said edge trim piece is located at one end of said desk top; there being another edge trim piece at the opposite end of said top which is identical to said first edge trim piece except that it includes no access opening therethrough; said trim pieces at said opposite ends of said desk being interchangeable whereby wiring can be passed through which ever end of the desk is desired.

5. In a desk, table or the like with a top having an exterior surface, an interior surface and an edge, and with a side panel having an exterior surface, an interior surface and an edge, an improved wiring access system comprising; said side panel being oriented with respect to said top such that said top edge and said side panel edges are both exposed and adjacent one another; an edge trim piece for locating at the juncture of said top and side panel, said edge trim piece having a first inside surface for aligning with and facing said top edge and a second inside surface for aligning with and facing said side panel edge whereby when said edge trim piece is in position at the juncture of said top and side panel, said top edge and said side panel edge are concealed from view; releasable securing means on said edge trim piece and on at least one of said top and side panel for releasably securing said edge trim piece thereto; a large access opening through at least one of said top and side panel, said large access opening extending from said edge through to said interior surface of said one of said top and side panel, but not extending through said exterior surface of said one of said top and side panel whereby said large access opening is normally covered by said trim piece; said large access opening being large enough to allow a user to readily feed wiring with large connectors therethrough; said edge trim piece including a relatively smaller access opening for allowing wiring to pass therethrough, said relatively smaller access opening being much less noticeable than said large access opening would be, and said relatively smaller opening including an open side facing said large access opening whereby it can be fitted over wiring or the like without the necessity of feeding large connectors or the like therethrough.

6. The desk of claim 5 which includes an insert member having at least two apertures therethrough of differing sizes, and insert receiving means located within said small access opening in said trim piece; said insert receiving means and said insert being matingly engageable in at least two different positions with one or the other of said apertures opening to the exterior of said desk whereby the larger of said openings can be oriented to the exterior of said desk when larger diameter wiring has to pass from the interior to the exterior of said desk and the smaller of said openings can be oriented outwardly when smaller diameter wiring has to pass from the interior to the exterior of said desk.

7. The desk of claim 6 in which said insert has at least one open end facing inwardly towards said edge of said top; said large access opening extending at least in part through said top and said edge of said top whereby at least a portion of said large access opening aligns with said open end of said insert; said insert apertures being located on different faces of said insert which are adjacent said open end and said insert apertures opening into said open end whereby wiring can pass through said large access opening, through said open end of said insert and out through only one of said insert apertures if necessary.

8. The desk of claim 7 in which said insert has at least three sides terminating at said open end, each including an aperture which opens into said open end, said apertures being of three different sizes, whereby wiring will pass through said open end and out through one of said insert apertures.

9. The desk of claim 8 in which said trim piece includes a plurality of recesses within at least one inwardly facing face thereof; there being at least one clip located within each said recess; and there being a stud for each said clip located on one of the end edge of said desk top and the upper edge of said desk side; said studs facing said clips once said trim piece is installed whereby said clips can be fitted over said studs to secure said trim piece in place.

10. The desk of claim 9 in which said edge trim piece is located at one end of said desk top; there being another edge trim piece at the opposite end of said top which is identical to said first edge trim piece except that it includes no access opening therethrough; said trim pieces at said opposite ends of said desk being interchangeable whereby wiring can be passed through which ever end of the desk is desired.

11. The desk of claim 5 in which said trim piece includes a plurality of recesses within at least one inwardly facing face thereof; there being at least one clip located within each said recess; and there being a stud for each said clip located on one of the end edge of said desk top and the upper edge of said desk side; said studs facing said clips once said trim piece is installed whereby said clips can be fitted over said studs to secure said trim piece in place.

12. The desk of claim 11 in which said edge trim piece is located at one end of said desk top; there being another edge trim piece at the opposite end of said top which is identical to said first edge trim piece except that it includes no access opening therethrough; said trim pieces at said opposite ends of said desk being interchangeable whereby wiring can be passed through which ever end of the desk is desired.

13. The desk of claim 5 in which said large access opening extends through both said top and said side panel.

* * * * *

UNITED STATES PATENT AND TRADEMARK OFFICE

CERTIFICATE OF CORRECTION

PATENT NO. : 4,163,867

DATED : August 7, 1979

INVENTOR(S) : James H. Breidenbach

It is certified that error appears in the above-identified patent and that said Letters Patent are hereby corrected as shown below:

Column 1, Line 65:

"than" should be -- that --

Column 4, Line 9:

"slidable" should be -- visible --

Column 5, Line 28:

Before "apertures" insert -- insert --

Signed and Sealed this

*Fifth* Day of *February 1980*

[SEAL]

*Attest:*

SIDNEY A. DIAMOND

*Attesting Officer*

*Commissioner of Patents and Trademarks*